US008029159B2

(12) United States Patent
Chen

(10) Patent No.: US 8,029,159 B2
(45) Date of Patent: Oct. 4, 2011

(54) LIGHT SOURCE DEVICE HAVING DIFFERENT COLOR TEMPERATURE ROTATING LIGHTING MODULES

(75) Inventor: Pin-Chun Chen, Chung-Ho (TW)

(73) Assignee: Edison Opto Corporation, Taipei (TW)

( * ) Notice: Subject to any disclaimer, the term of this patent is extended or adjusted under 35 U.S.C. 154(b) by 535 days.

(21) Appl. No.: 12/258,606

(22) Filed: Oct. 27, 2008

(65) Prior Publication Data

US 2010/0103659 A1 Apr. 29, 2010

(51) Int. Cl.
*F21S 4/00* (2006.01)
*F21V 21/30* (2006.01)

(52) U.S. Cl. ..... 362/249.1; 362/231; 362/233; 362/249.03; 362/287; 362/428

(58) Field of Classification Search ..... 362/219, 362/225, 231, 233, 249.02, 249.03, 249.05, 362/249.07, 249.1, 287, 427, 428
See application file for complete search history.

(56) References Cited

U.S. PATENT DOCUMENTS

| | | | | |
|---|---|---|---|---|
| 739,845 | A * | 9/1903 | Evans | 362/35 |
| 5,091,828 | A * | 2/1992 | Jincks et al. | 362/35 |
| 5,426,417 | A * | 6/1995 | Stanuch | 362/35 |
| 5,662,405 | A * | 9/1997 | Kuo | 362/473 |
| 5,688,042 | A * | 11/1997 | Madadi et al. | 362/240 |
| 5,842,768 | A * | 12/1998 | Menke | 362/35 |
| 7,311,423 | B2 * | 12/2007 | Frecska et al. | 362/372 |
| 7,488,086 | B2 * | 2/2009 | Wu et al. | 362/225 |
| 2010/0214782 | A1 * | 8/2010 | Allegri | 362/249.07 |

* cited by examiner

*Primary Examiner* — Ismael Negron
(74) *Attorney, Agent, or Firm* — Chun-Ming Shih; HDLS IPR Services

(57) ABSTRACT

A light source device capable of switching to different color temperature planes includes a cooler, a first lighting module, a second lighting module and a rotating mechanism. The cooler has a first surface and a second surface formed at one side of the first surface. The first and second surfaces are non-coplanar to each other. The first lighting module is arranged onto the first surface by adhesion and the second lighting module is arranged onto the second surface by adhesion. The first lighting module and the second lighting module can radiate light of different color temperatures respectively. The rotating mechanism, which is connected to the cooler, provides a rotating operation to the cooler. When the first surface or the second surface is rotated for radiating light, the first lighting module or the second lighting module can emit an illumination of different colors.

15 Claims, 5 Drawing Sheets

LIGHT SOURCE DEVICE HAVING DIFFERENT COLOR TEMPERATURE ROTATING LIGHTING MODULES

BACKGROUND OF THE INVENTION

1. Field of the Invention

The present invention generally relates to a light source device, in particular, to a light source device capable of switching to different color temperature planes.

2. Description of Prior Art

A common light source device, for example, desk lamp or indoor LED fixture, etc., includes a light source module that is comprised of red LED light source, blue LED light source and green LED light source. By adjusting the brightness of these three color lights and mixing these three color lights in proportion, it can provide an illumination of white light in different color temperatures.

According to one prior art, an illuminating system capable of adjusting color temperature mainly includes a light source module and a light mixing structure. The light source module is comprised of three color lights for generating a light source color with needed color temperature, while the light mixing structure can change the transmitting direction of the light. Thereby, the white light's color temperature is further changed via following operations. First, by changing the proportion of three color lights, the light source module adjusts the brightness of the lighting source for each color; second, through a light mixing of multiple reflections, the mixing structure generates a uniform light distribution.

In addition, according to another prior art, a fixture capable of changing lighting intensity and color temperature mainly includes a seat body, a plurality of LED light source and a control circuit. The seat body is provided with a column-shaped reflecting trough defined thereon, in which the LED light source are accommodated. The control circuit is electrically connected to the LED light source to thereby control the brightness of the LED light source with different colors. After being mixed in the reflecting trough, the light of the LED light source further radiates out for providing an illumination of white light in different color temperatures.

However, above illuminating system and fixture of prior arts still have following shortcomings in terms of practical usages. First, a control circuit must be applied to achieve a brightness adjustment for the light source module or the LED light source, but the designing and manufacturing procedure of the control circuit is very time-consuming and complex. Second, in order to uniformly mix the lights of three colors, the light mixing structure or the seat body must additionally be provided with a column-shaped reflecting trough. Because their structures are substantially complicated, the entire cost increases in terms of manufacture, Accordingly, aiming to solve aforementioned shortcomings, after a substantially devoted study, in cooperation with the application of relatively academic principles, the inventor has at last proposed the present invention that is designed reasonably to possess the capability to improve the prior arts significantly.

SUMMARY OF THE INVENTION

The invention is mainly to provide a light source device capable of switching to different color temperature planes. Through driving a rotating mechanism to operation, a cooler is rotated by taking a drive shaft center as rotating center thus that, by switching the first and second lighting modules respectively to emit white light of different color temperatures, white light source with a variation of color temperature is achieved. Since there is no arrangement of complicated control circuit, the entire structure is fairly simple, and an effectiveness of cost saving is thereby possessed.

Secondly, the invention is to provide a light source device capable of switching to different color temperature planes. Through switching the first and second lighting modules respectively having white light of different color temperatures, an effectiveness of scenario variation is thereby achieved.

Accordingly, the invention provides a light source device, capable of switching to different color temperature planes, including a cooler, a first lighting module, a second lighting module and a rotating mechanism. The cooler has a first surface and a second surface formed at one side of the first surface. The first and second surfaces are non-coplanar to each other. The first lighting module is arranged onto the first surface by adhesion, and the second lighting module is arranged onto the second surface by adhesion. The first lighting module and the second lighting module can radiate light of different color temperatures respectively. The rotating mechanism, which is connected to the cooler, provides a rotating operation to the cooler. When the first surface or the second surface is rotated for radiating light, the first lighting module or the second lighting module can create an illumination of different colors respectively.

Moreover, the invention is to provide a light source device capable of switching to different color temperature planes, through additionally forming a third surface between the first and second surfaces and additionally arranging a third lighting module by adhesion to the third surface, thus that a switching can be chosen among the first, second and third lighting modules to appropriately decide a color temperature of white light to achieve an effectiveness of scenario variation.

Finally, the invention is to provide a light source device capable of switching to different color temperature planes, through arranging a plurality of troughs in the cooler for increasing its cooling area, thus that the cooling efficiencies of the first, second and third lighting modules are further enhanced significantly.

BRIEF DESCRIPTION OF DRAWING

The features of the invention believed to be novel are set forth with particularity in the appended claims. The invention itself, however, may be best understood by reference to the following detailed description of the invention, which describes a number of exemplary embodiments of the invention, taken in conjunction with the accompanying drawings, in which:

DETAILED DESCRIPTION OF THE INVENTION

In cooperation with attached drawings, the technical contents and detailed description of the present invention are described thereinafter according to a number of preferable embodiments, being not used to limit its executing scope. Any equivalent variation and modification made according to appended claims is all covered by the claims claimed by the present invention.

Figure 1:
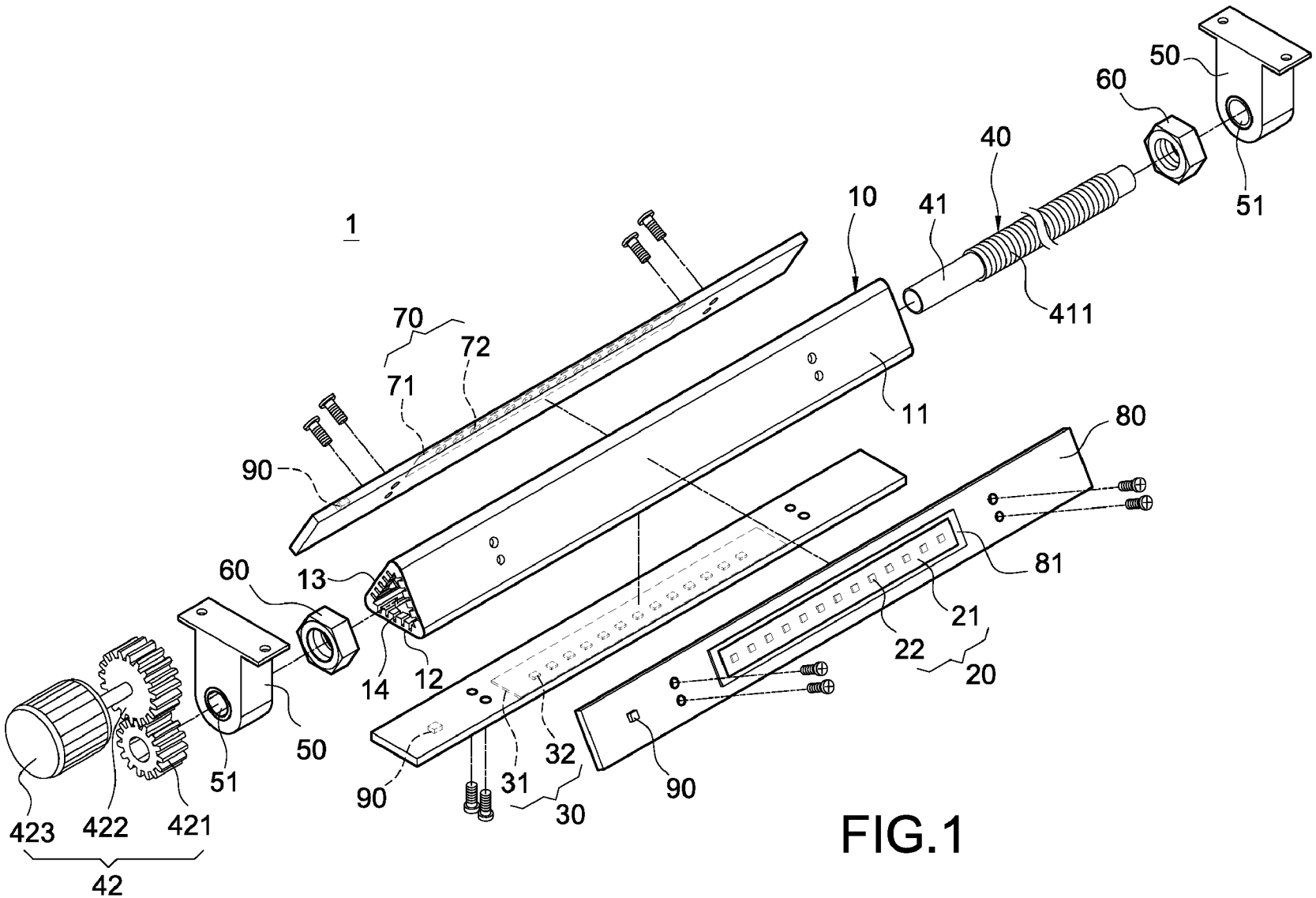
FIG. 1 is a perspective exploded illustration of the present invention.
Figure 2:
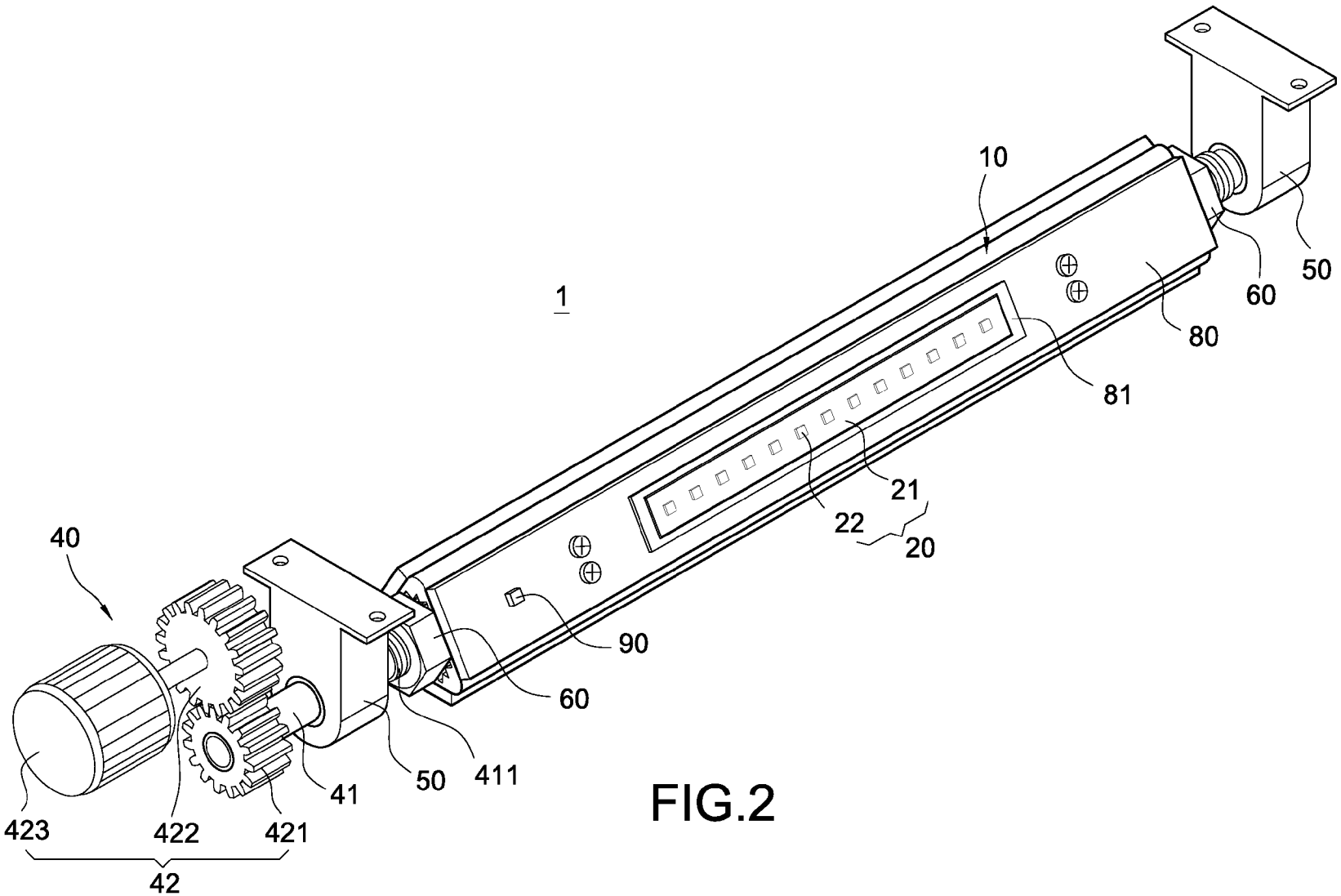
FIG. 2 is a perspective assembled illustration of the present invention.

Please refer to FIG. 1 and FIG. 2. According to the present invention, a light source device 1 capable of switching to different color temperature planes includes a cooler 10, a first lighting module 20, a second lighting module 30 and a rotating mechanism 40.

The cooler 10 has a first surface 11, a second surface 12 formed at one side of the first surface 11 and a third surface 13 formed between the first and second surfaces 11, 12. The first, second and third surfaces 11, 12, 13 are non-coplanar. The cooler 10 can be a triangular tube made by aluminum extrusion. A plurality of troughs 14 are arranged on the inner wall surfaces of the triangular tube to increase its cooling area.

The first lighting module 20 includes a first printed circuit board 21 and a first LED light source 22 electrically connected to the first printed circuit board 21. The first printed circuit board 21 is arranged by adhesion onto the first surface 11. The first LED light source 22 can be a reddish LED light source or a white-light LED light source having a specific color temperature.

The second lighting module 30 includes a second printed circuit board 31 and a second LED light source 32 electrically connected to the second printed circuit board 31. The second printed circuit board 31 is arranged by adhesion onto the second surface 12. In this case, the second LED light source 32 and the first LED light source 22 can radiate white light of different color temperatures respectively. The second LED light source 32 can be a blueish LED light source or a white-light LED light source having a specific color temperature.

The rotating mechanism 40 is connected to the cooler 10 and provides a rotating operation to the cooler 10, such that the usage can switched between the first or second lighting modules 20, 30. The rotating mechanism 40 includes a drive shaft 41 penetrating through the cooler 10 and a reduction gear assembly 42 inter-engaged with and rotated by the drive shaft 41. The reduction gear assembly 42 includes a first gear 421 fitted onto the drive shaft 41, a second gear 422 inter-engaged with and driven by the first gear 421 and a motor 423 connected to the second gear 422. The motor 423 can be stepper motor.

According to a preferable embodiment of the invention, two fixing seats 50 are further included and are respectively arranged to two sides of the drive shaft 41 for fixing the entire drive shaft 41. The two fixing seats 50 are respectively arranged a pivotal hole 51 for respectively pivoting the two sides of the drive shaft 41.

In this case, two nuts are further included, while the outer circumference of the drive shaft 41 is formed with threads 411. The two nuts 60 are respectively screwed onto the threads 411 and abut the cooler 10 securely between the two nuts 60.

This preferable embodiment further includes a third lighting module 70 that includes a third printed circuit board 71 arranged to the third surface 13 of the cooler 10 by adhesion and a third LED light source 72 electrically connected to the third printed circuit board 71. The third LED light source 72 emits white light with a color temperature different from that of the first LED light source 22 and the second LED light source 32 respectively. The third LED light source 72 can be a yellowish LED light source or a white light LED light source having a specific color temperature.

This preferable embodiment further includes three fixing plates 80, which respectively correspond to the first, second and third surfaces 11, 12, 13 and are connected securely thereto. The fixing plates 80 are respectively arranged an opening 81 provided for the first, second and third lighting modules 20, 30, 70 to be inset therein and fixed thereto respectively. The fixing plates 80 can be respectively connected to the surfaces 11, 12, 13 securely by manners of thread screwing, glue adhesion or hook buckling-up etc., not limited by the connecting manner of thread screwing illustrated in the drawings.

According to a preferable embodiment, a sensing module 90 respectively electrically connected to the lighting modules 20, 30, 70 are further included. The sensing module 90 can be a gravity sensor for sensing a gravity to thereby transmit a signal to the first, second and third lighting modules 20, 30, 70 to turn on or turn off the first, second and third LED light source 22, 32, 72.

Figure 4:
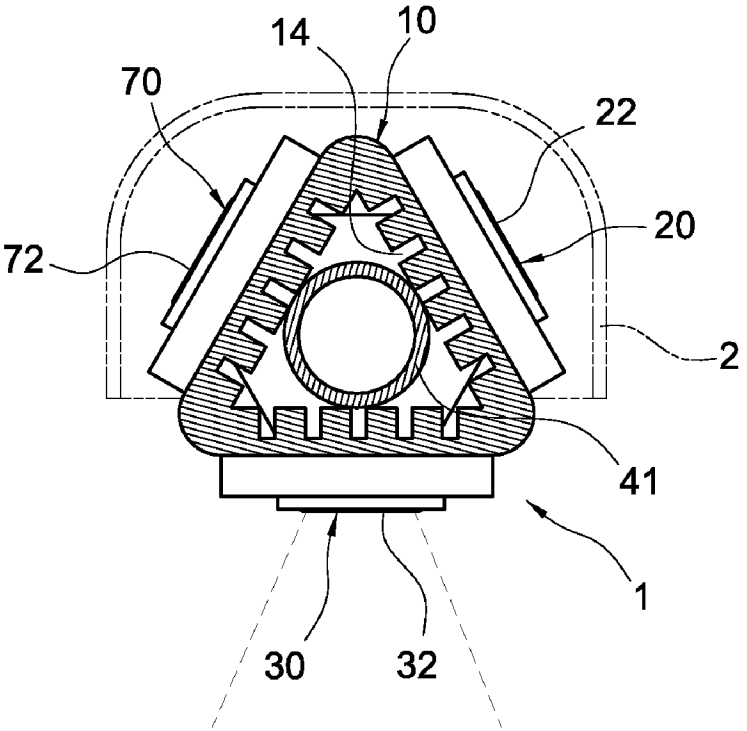
FIG. 4 is a using status view (2) of the present invention.
Figure 3:
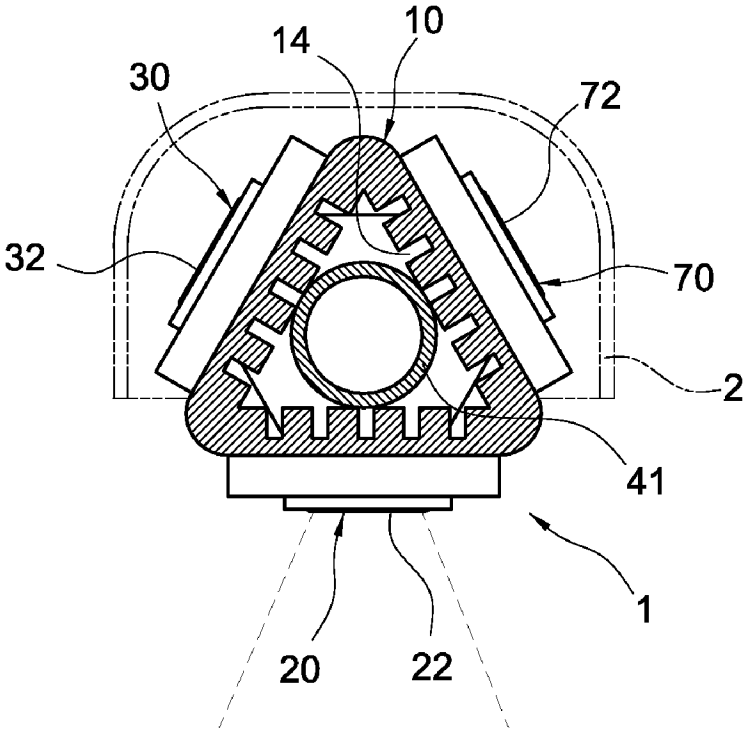
FIG. 3 is a using status view (1) of the present invention.

When using the invention, please refer to FIG. 3 and FIG. 4. First, the invention is arranged in a lampshade 2 with motor 423 and the lighting modules 20, 30, 70 being connected to a power source. When the reduction gear assembly 42 is driven to operation, the drive shaft 41 is brought along to rotation and the cooler 10 is rotated by taking the center of the drive shaft 41 as a rotating center. Therefore, a lighting module intended to use is selected from one of the first lighting module 20, the second lighting module 30 or the third lighting module 70 by switching.

When switching to the first lighting module 20 intended for use, the sensing module 90 senses a gravity and then sends out a turning-on signal to the first lighting module 20 for turning on the first LED light source 22 to radiate light source (e.g., reddish light). In the meantime, a turning-off signal is respectively sent to the second and third lighting modules 30, 70 for shutting the second and third LED light source 32, 72.

When switching to the second lighting module 30 intended for use, the sensing module 90 senses a gravity and then sends out a turning-on signal to the second lighting module 30 for turning on the second LED light source 32 to radiate light source (e.g., blueish light). In the meantime, a turning-off signal is respectively sent to the first and third lighting modules 20, 70 for turning off the first and third LED light source 22, 72.

When switching to the third lighting module 70 intended to use, the sensing module 90 is senses a gravity and then sends out a turning-on signal to the third lighting module 70 for turning on the third LED light source 72 to radiate light source (e.g., yellowish light). In the meantime, a turning-off signal is respectively sent to the first and second lighting modules 20, 30 for shutting the first and second LED light source 22, 32.

Thereby, it can switch to the first, second and third lighting modules 20, 30, 70 to use different color temperatures of white light with a simple structure and without any complicated control circuit, thereby an effectiveness of cost saving is achievable.

However, during the using procedure of the invention, the first, second and third LED light source 22, 32, 72 can be turned on simultaneously or the first and second LED light source 22, 32 can be turned on at same time by turning off the third LED light source 72 without use. The lighting modules 20, 30, 70 can be rotated by rotating the cooler 10. Therefore, a multicolored and colorful effectiveness is achieved.

Figure 5:
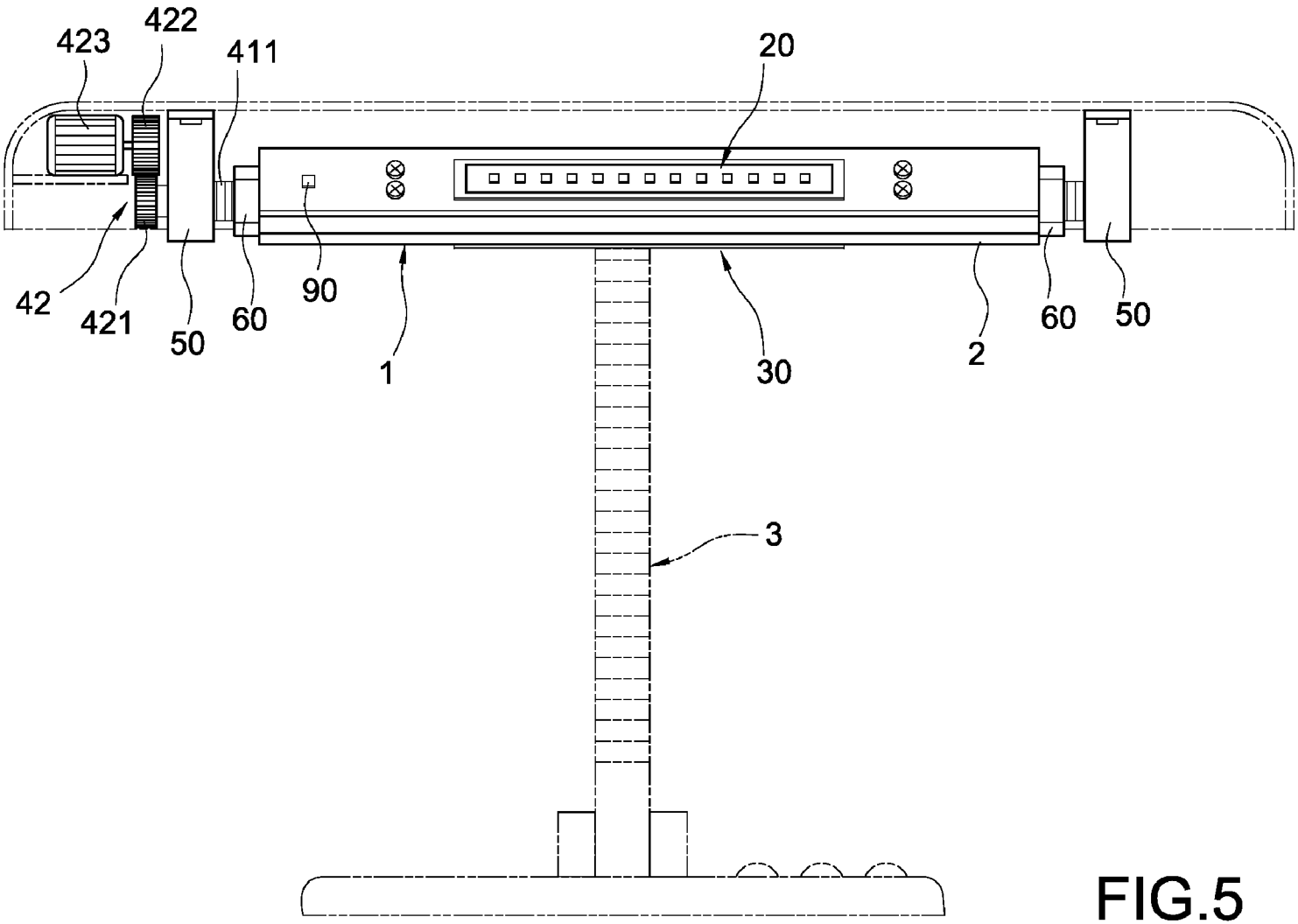
FIG. 5 is another embodiment of the present invention.

Furthermore, please refer to FIG. 5, showing another preferable embodiment of the present invention, in which the light source device 1 is applicable to an ordinary desk lamp 3 (or bedside lamp, night light, etc.) for replacing a lamp tube set up in the desk lamp 3 or a pattern of lighting module set up only with fixed color temperature. In the meantime, based on different atmospheres, the first, second and third lighting modules 20, 30, 70 can be switched alternatively to choose a white light with appropriate color temperature(for example, during night, a yellowish white light can be chosen to create a warm scenario, further helping to fall asleep).

Figure 6:
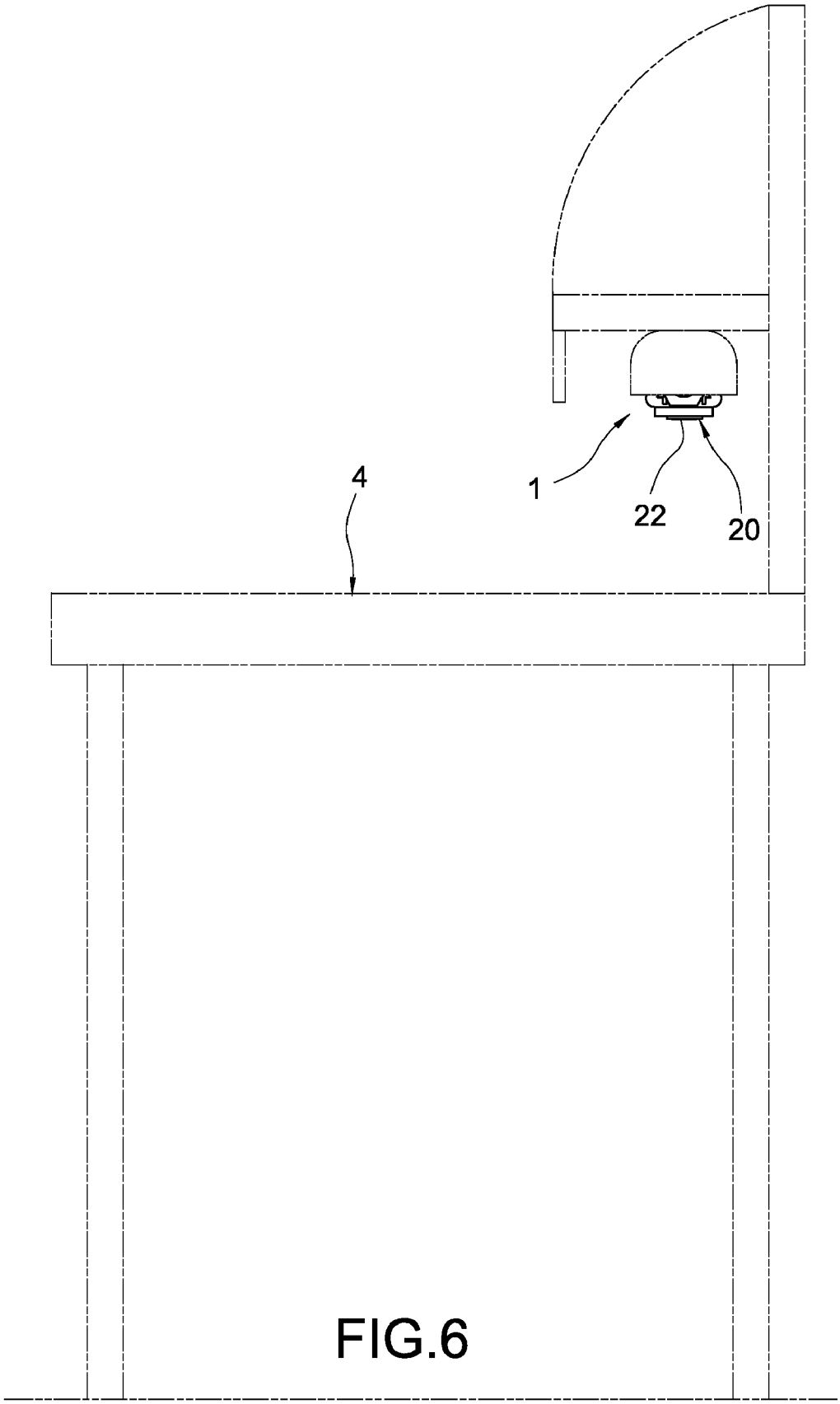
FIG. 6 is a further embodiment of the present invention.

Please refer to FIG. 6, showing a further embodiment of the invention, in which a lighting device 1 can be integrated in a common desk 4. When a user uses the desk 4 for reading book or lying face down for a rest because of tiredness, different lights can be switched by the user for creating a comfortable scenario for reading or resting.

However, not only applicable to common desk lamp 3, desk 4, beside lamp or night light, the invention is but also applicable to different occasions, for example, a lamplight illumination in product exhibition, dancing party or other places needing the creation of atmosphere, but these are not the limitations.

Summarizing aforementioned description, the application of the invention can reach the effectiveness of scenario variation and has the function of cost saving. Thereby, all kinds of shortcomings of the prior arts are solved. The invention indeed possesses a high application value in relative industry.

What is claimed is:

1. A light source device having different color temperature rotating lighting modules, including:

a cooler bar, having a first surface and a second surface formed at one side of the first surface, the first and second surfaces being non-coplanar to each other;

a first lighting module, arranged by adhesion onto the first surface;

a fixing plate that is arranged onto the first surface and has an opening into which the first lighting module is inset securely a second lighting module, arranged by adhesion onto the second surface, the first lighting module and the second lighting module being able to radiate light of different color temperatures respectively; and a rotating mechanism, connected to the cooler bar and providing a rotating operation to the cooler bar;

wherein the first lighting module or the second lighting module can create an illumination of different colors, when the first surface or the second surface is rotated for radiating light.

2. The light source device having different color temperature rotating lighting modules according to claim 1, wherein the first lighting module includes a first printed circuit board arranged onto the first surface by adhesion and a first LED light source electrically connected to the first printed circuit board.

3. The light source device having different color temperature rotating lighting modules according to claim 1, wherein the second lighting module includes a second printed circuit board arranged onto the second surface by adhesion and a second LED light source electrically connected to the second printed circuit board.

4. The light source device having different color temperature rotating lighting modules according to claim 1, wherein the cooler bar is a triangular tube.

5. The light source device having different color temperature rotating lighting modules according to claim 4, wherein a plurality of troughs are defined on an inner wall surface of the triangular tube.

6. The light source device having different color temperature rotating lighting modules according to claim 1, wherein the rotating mechanism includes a drive shaft penetrating through the cooler bar and a reduction gear assembly inter-engaged with and rotated by the drive shaft.

7. The light source device having different color temperature rotating lighting modules according to claim 6, wherein the reduction gear assembly includes a first gear fitting onto the drive shaft, a second gear rotated by inter-engaging to the first gear and a motor connected to the second gear.

8. The light source device having different color temperature rotating lighting modules according to claim 6, further including two fixing seats respectively arranged a pivotal hole for pivoting at two sides of the drive shaft.

9. The light source device having different color temperature rotating lighting modules according to claim 6, further including two nuts respectively screwed to threads formed at an outer circumference of the drive shaft.

10. The light source device having different color temperature rotating lighting modules according to claim 1, further including a third lighting module, and the cooler bar further comprises a third surface formed between the first and second surfaces of the cooler bar and onto which the third lighting module is arranged by adhesion.

11. The light source device having different color temperature rotating lighting modules according to claim 10, further including a sensing module electrically connected to the lighting modules respectively.

12. The light source device having different color temperature rotating lighting modules according to claim 11, wherein the sensing module is a gravity sensor.

13. The light source device having different color temperature rotating lighting modules according to claim 10, wherein the third lighting module includes a third printed circuit board arranged onto the third surface by adhesion and a third LED light source electrically connected to the third printed circuit board.

14. The light source device having different color temperature rotating lighting modules according to claim 13, wherein the third lighting module has a color temperature different from that of the first lighting module.

15. The light source device having different color temperature rotating lighting modules according to claim 13, wherein the third lighting module has a color temperature different from that of the second lighting module.

* * * * *